United States Patent [19]

Klett

[11] 3,997,988

[45] Dec. 21, 1976

[54] ONE-PIECE REPLACEABLE CUTTING EDGE AND TOOTH ADAPTER WITH TOOTH

[75] Inventor: Gene R. Klett, Joliet, Ill.

[73] Assignee: Caterpillar Tractor Co., Peoria, Ill.

[22] Filed: Sept. 2, 1975

[21] Appl. No.: 609,873

Related U.S. Application Data

[63] Continuation of Ser. No. 406,815, Oct. 16, 1973, abandoned.

[52] U.S. Cl. ..... 37/141 R; 37/142 R

[51] Int. Cl.[2] ..... E02F 9/28; 172 699;713;762

[58] Field of Search ..... 37/141 R, 141 T, 142 R, 37/142 A; 172/699, 713, 762

[56] References Cited

UNITED STATES PATENTS

| | | | |
|---|---|---|---|
| 1,921,491 | 8/1933 | Van Buskirk | 37/141 T |
| 1,959,847 | 5/1934 | Van Buskirk | 37/141 T |
| 3,160,967 | 12/1964 | Nichols | 37/142 A |
| 3,456,370 | 7/1969 | Gilbertson | 37/141 R |
| 3,469,331 | 9/1969 | Wood | 37/141 R |
| 3,623,247 | 11/1971 | Stepe | 172/713 X |
| 3,685,177 | 8/1972 | Hahn et al. | 37/141 R |
| 3,736,664 | 6/1973 | Black et al. | 37/141 R |
| 3,762,079 | 10/1973 | Lukavich et al. | 37/141 R |
| 3,765,109 | 10/1973 | Daviduke | 37/141 R |

FOREIGN PATENTS OR APPLICATIONS

| | | | |
|---|---|---|---|
| 647,084 | 8/1962 | Canada | 37/142 A |
| 18,543 | 11/1897 | United Kingdom | 37/142 R |

*Primary Examiner*—E. H. Eickholt
*Attorney, Agent, or Firm*—Phillips, Moore, Weissenberger, Lempio & Strabala

[57] ABSTRACT

A one-piece cutting edge and tooth adapter assembly for operative attachment to the earth working surface of an earth moving device. The one-piece cutting edge and tooth adapter assemblage is provided in discretely removable modules having either singular or plural adapter means. A tooth is provided for readily replaceable mating connection to each adapter means. Upon wear of a particular earth working tooth or a particular cutting edge and an adapter module, only the particular worn component need be replaced and this is accomplished without disturbance of the other components.

6 Claims, 2 Drawing Figures

ONE-PIECE REPLACEABLE CUTTING EDGE AND TOOTH ADAPTER WITH TOOTH

This is a continuation of Ser. No. 406,815, filed Oct. 16, 1973 and now abandoned.

BACKGROUND OF THE INVENTION

Presently, many earth moving machines such as buckets, loaders, scrapers, and bulldozers are fitted with cutting edges and with teeth which project forwardly of the cutting edges. The teeth tend to break up the earth or other working medium to increase penetration of the cutting edges as well as to increase the overall efficiency of the machine. Replaceable cutting edges and teeth are essential inasmuch as the main earth working surface, i.e. the bucket bottom, the scraper blade, etc., is usually far too costly to subject to localized wear.

The earth working surfaces of such machines are usually protected by such cutting edge and tooth assemblies in areas which are in almost constant contact with earth, rock, sand and other abrasive materials. Because of this, the useful life of these individual components is relatively short. To improve the useful life of such working components, especially cutting edges, various innovations have been employed.

Heavier metal sections have been utilized for the individual cutting edge and stronger materials such as alloy steel as well as hardening heat treatments for the cutting edge surfaces have been employed with varying results.

Tooth assemblies, which are most advantageously utilized to form a leading edge for the cutting edges in extremely hard and relatively impenetrable working mediums, have also extended the wear life of the associated cutting edges inasmuch as they act as a shield for such cutting edges.

There have been numerous prior art attempts to provide replaceable cutting edges and replaceable tooth members for earth working surfaces. Some attempts have involved the use of bolt-on adapters for securing teeth to the cutting edge elements. Since earth working teeth are often very heavily loaded, such bolts were subject to breakage under shear forces and the tooth adapters often broke under the stresses applied. To overcome this problem, integral teeth and cutting edge modules were introduced. Examples of such innovations are found in U.S. Pat. No. 3,059,357 to Irish and U.S. Pat. No. 3,653,133 to Black et al., of common assignment herewith. Such one-piece cutting edge and tooth designs effectively eliminated premature bolt and adapter breakage but introduced a new problem.

In such integral cutting edge and tooth assemblies, tooth wear is much more rapid than cutting edge wear. Once the tooth is worn away, the cutting edge is no longer capable of providing good penetration in hard surface working mediums. In order to provide the machine with a new tooth element, the relatively unworn integral cutting edge portion must be discarded. This obvious waste of material is inefficient and highly disadvantageous economically.

Other prior art attempts to provide various replaceable components for earth working surfaces are found in U.S. Pat. Nos. 2,113,420, 2,385,395, 2,393,706, 2,798,403, 2,874,491, 2,925,673, 3,440,745 to Younie, Baer, Page, Launder, Larsen, Sennholtz, and Palm respectively.

SUMMARY AND OBJECTS OF THE INVENTION

The instant invention provides an economical and efficiently operable one-piece cutting edge and tooth adapter assembly and a replaceable tooth for operative association therewith. The cutting edge and adapter components are cast in singular and plural adapter embodiments to suit various earth working requirements. The adapters and the teeth therefor are dimensioned such that there is a uniform load distribution taken upon the adapter such that no appreciable shearing force is transmitted to the readily replaceable pins or other fastening means utilized for nominal connection of the teeth members to the adapters.

The main object of the present invention is to provide a one-piece cutting edge and tooth adapter assembly and a tooth member therefor which may be attached to the earth working surface of an earth moving machine and which may be replaced component by component as needed upon wear.

Another object of the invention is to provide a one-piece cutting edge and adapter assembly which fully supports an earth working tooth member while providing a uniform stress distribution throughout the components.

Other objects and advantages of the invention will become apparent from the following description and drawing.

DETAILED DESCRIPTION

Figure 1:
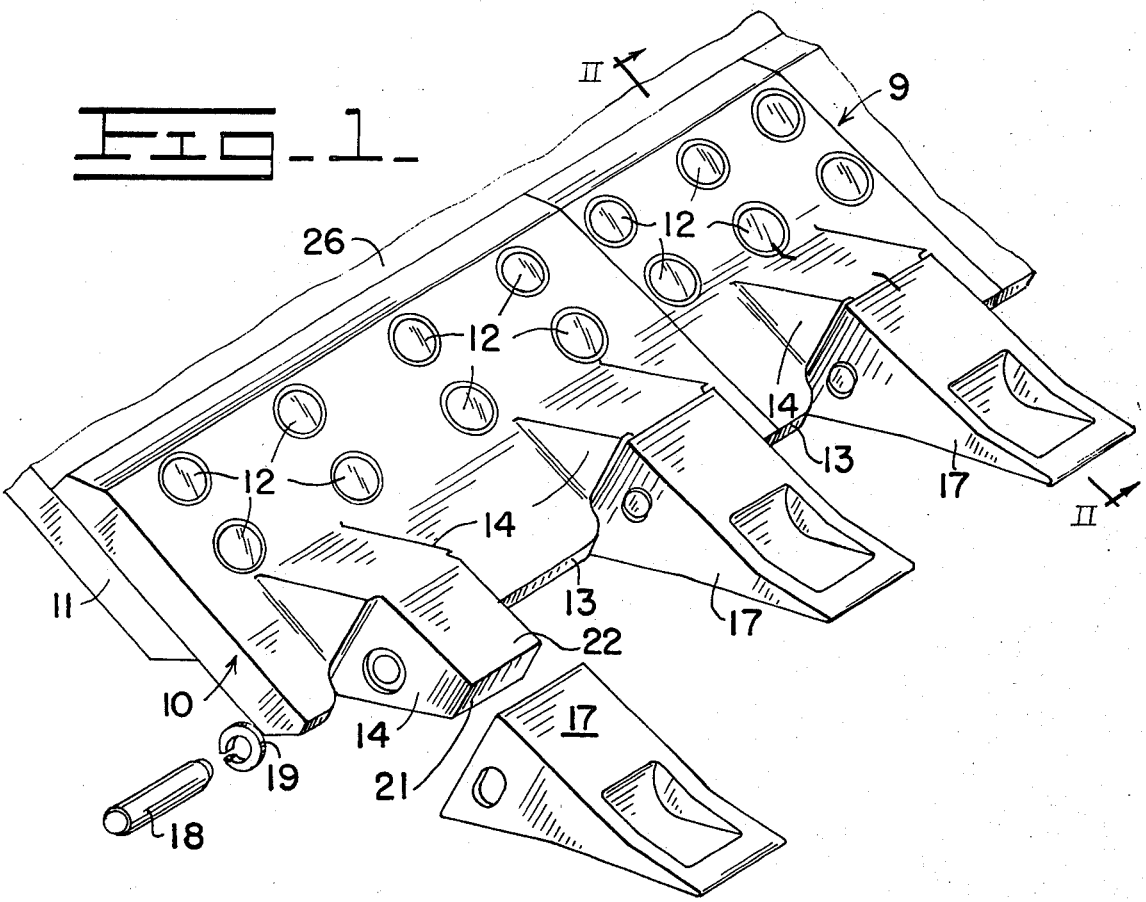
FIG. 1 is an isometric view of two one-piece cutting edge and adapter modules attached to an earth working surface and showing means for connecting earth working teeth members thereto.

With reference to the drawing, two one-piece cutting edge and tooth adapter assemblies or modules 9 and 10 are shown secured to an earth working surface 11 of an earth moving machine by means of a plurality of bolt assemblies 12.

The one-piece module 10 includes a cutting edge portion 13 and a plurality of tooth adapters 14. In the usual application, the entire earth working surface 11 of the machine would be protectively covered by a plurality of one-piece multi-adapter modules 10 either alone or in combination with a plurality of single adapter modules 9 such that the entire earth working surface 11 would be wear protected during use.

A hardened earth working tooth 17 is provided for mating attachment to each of the adapters 14 of the one-piece cutting edge and adapter modules. The teeth are conviently secured upon the adapters by means of readily removable conventional retaining means such as a pin 18 and a span ring 19. The particular retaining means used are not critical inasmuch as they do not bear substantial loading during use, due to the particular design of and mating relationship between the adapters and the teeth.

Figure 2:
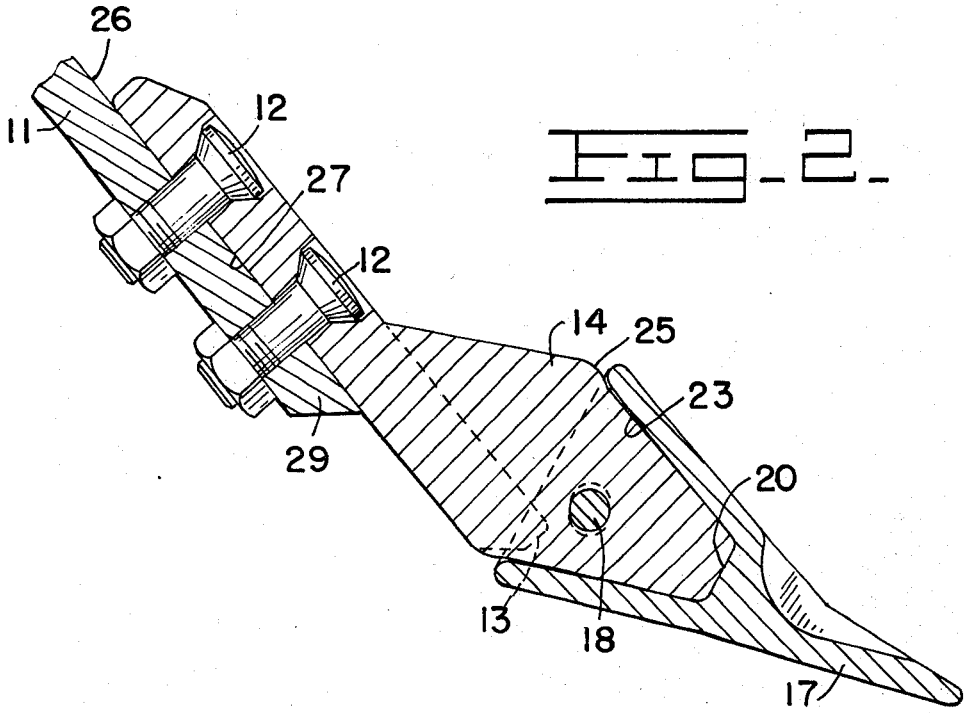
FIG. 2 is a cross-sectional view taken along the line II—II of FIG. 1.

As may be seen in the drawing, the bolt assemblies 12 are recessed within counterbores beneath the upper surface portions of the one-piece cutting edge and tooth adapter modules. In such disposition they are not exposed to appreciable wear. With particular reference to FIG. 2 of the drawing, it will be noted that a particularly advantageous stress distribution is achieved by virtue of the construction of the adapter members and teeth. Each tooth has a hollowed out converging interior bore with a flat abutment surface 20, as shown. Each adapter 14 is equipped with a similar abutment surface 21 for precise mating with the abutment surface 20. The degree of convergence of the surfaces 22 of each adapter member is slightly less than that of the interior surfaces 23 of the tooth members so as to produce a tight fit between the surfaces 20 and 21 and a slight tolerance between the surfaces 22 and 23 in the vicinity of a protrusion or shoulder portion 25 of the adapter members. The pin 18 is placed through mating bores and apertures in the adapter and tooth members respectively such that it absorbs little or no compressive or shear stresses when the surface 20 of the tooth member is in mating engagement with the surface 21 of the adapter member. The pin fastening means 18 serves primarily to prevent the tooth member 17 from falling axially away from the adapter member 14 primarily under the influence of its own weight.

The particular disposition and configuration of the bolt means 12 rearwardly of the adapter members 14 also aids in producing an even stress distribution in the earth working surface 11. As shown, the upper-most portion 26 of the earth working surface 11 engges a substantial portion of the lowermost surface 27 of the cutting edge module and stress distribution is throughout the entire mating area. Under normal loading conditions, the bolts 12 are in tensile stress and act to prevent the tipping of rotation of the cutting edge adapter modules about a point somewhere in the vicinity 29 of the earth working surface 11.

As previously stated, since the teeth 17 initially engage the soil and rock through which the modules pass, they generally wear at a rate faster than that of the edge portions 13. The teeth 17 are relatively inexpensive, however, and may be replaced in the instant invention without undue difficulty when worn. In practice, the teeth are replaceable approximately ten times more frequently than are the cutting edge portions of adapter modules 9 and 10. The adapters are preferably cast integrally with the cutting edge portions to provide greater strength than would be possible with prior art bolt-on adapters. With the present invention, if one of the teeth 17 wears more rapidly than other teeth, it can readily be replaced without disturbing any other component. In a like fashion, any one-piece cutting edge and adapter module may be advantageously replaced without disturbing the other such modules.

While the invention has been described with particular reference to the preferred embodiments, it is apparent that variations and modifications are possible within the purview of the inventive concepts. No limitation with respect to such variations and modifications is intended, except by the scope of the appended claims.

I claim:

1. Detachable cutting edge and tooth adapter means for attachment to an earth working surface of an earth moving device, said cutting edge and tooth adapter means including a plurality of discrete modules separately attachable on said earth working surface, each module including at least one integrally formed cutting edge portion and an adapter portion formed as one piece of material and attachable as a unit to said earth working surface by replaceable fastening means, said adapter portion projecting outwardly beyond and upwardly relative to said cutting edge portion, replaceable tooth means mounted on said adapter portion to project outwardly and upwardly relative to said cutting edge portion, said adapter portion including a flat distally located abutment surface and said tooth means including a corresponding flat abutment surface disposed in mating engagement with said abutment surface of said adapter portion, said adapter portion including opposed first and second surfaces converging toward said flat abutment surface, and said tooth means including opposed third and fourth surfaces converging towards said flat abutment surface of said tooth means, said third and fourth surfaces converging at a rate greater than said first and second converging surfaces.

2. The invention of claim 1 wherein said replaceable fastening means include a plurality of evenly spaced apart bolts disposed within recessed portions of said cutting edge and adapter means.

3. The invention of claim 1 wherein said tooth means is removably attached to said adapter portion by attachment means, said tooth means including aperture means therein, said adapter portion having bore means therein, said tooth means being retained upon said adapter portion with said attachment means received concurrently within said aperture means and said bore means.

4. The invention of claim 3 wherein said attachment means include pin means and wherein said flat abutment surfaces and said converging surfaces constitute means for preventing compressive loading resultant from operation of said earth moving device from being transmitted from said tooth means to said pin means when said flat abutment surfaces of said adapter portion and said tooth means are in mating engagement.

5. The invention of claim 1 wherein some of each said discrete modules include a plurality of tooth adapter portions integrally formed with said cutting edge and others of said modules include only a single adapter portion formed integrally with said cutting edge.

6. The invention of claim 1 wherein said integrally formed cutting edge and adapter portion comprise a one-piece cast article.

* * * * *